US009386864B2

(12) United States Patent
Pongrac et al.

(10) Patent No.: US 9,386,864 B2
(45) Date of Patent: Jul. 12, 2016

(54) SCANNING CLIP

(71) Applicants: Ivan Pongrac, Keysborough (AU); John Pongrac, Keysborough (AU)

(72) Inventors: Ivan Pongrac, Keysborough (AU); John Pongrac, Keysborough (AU)

( * ) Notice: Subject to any disclaimer, the term of this patent is extended or adjusted under 35 U.S.C. 154(b) by 0 days.

(21) Appl. No.: 14/423,438

(22) PCT Filed: Aug. 23, 2013

(86) PCT No.: PCT/AU2013/000932
§ 371 (c)(1),
(2) Date: Feb. 24, 2015

(87) PCT Pub. No.: WO2014/028975
PCT Pub. Date: Feb. 27, 2014

(65) Prior Publication Data

US 2015/0216325 A1 Aug. 6, 2015

(30) Foreign Application Priority Data

Aug. 24, 2012 (AU) ..... 2012903651

(51) Int. Cl.
*A47F 1/12* (2006.01)
*A47F 5/08* (2006.01)

(52) U.S. Cl.
CPC ..... *A47F 1/128* (2013.01); *A47F 5/0807* (2013.01); *A47F 5/0861* (2013.01); *A47F 5/0869* (2013.01)

(58) Field of Classification Search
CPC ..... A47F 1/128; A47F 5/0807; A47F 5/0861; A47F 5/0869; G09F 3/20
USPC ..... 211/59.2, 59.3
See application file for complete search history.

(56) References Cited

U.S. PATENT DOCUMENTS

| | | | | |
|---|---|---|---|---|
| 1,033,915 | A * | 7/1912 | McDonald | 402/68 |
| 5,485,930 | A * | 1/1996 | Rushing | 211/59.1 |
| 5,901,487 | A * | 5/1999 | Thalenfeld et al. | 40/642.01 |
| 8,499,941 | B2 * | 8/2013 | Barkdoll et al. | 211/59.1 |
| 8,739,981 | B2 * | 6/2014 | Piskor | 211/59.2 |
| 2005/0081418 | A1 | 4/2005 | Fast et al. | |
| 2007/0119796 | A1 | 5/2007 | Barkdoll | |
| 2008/0309489 | A1 * | 12/2008 | Hachmann et al. | 340/568.8 |

* cited by examiner

*Primary Examiner* — Korie H Chan
(74) *Attorney, Agent, or Firm* — JMB Davis Ben-David

(57) ABSTRACT

A scanning bar hook for displaying packeted items in a shop, has upper and lower limbs with a crossbar extending from the upper limb. A molded plastic assembly pivoted on the crossbar has a display flap for mounting a bar code card, a fin extending from the flap toward the first item and an arrester arm which is insertable between the foremost item and the next item. When the foremost item is advanced for removal it strikes the fin and blocks the removal of all the remaining items.

20 Claims, 2 Drawing Sheets

SCANNING CLIP

CROSS-REFERENCE TO RELATED APPLICATIONS

This is the U.S. National Stage of International Application No. PCT/AU2013/000932, filed Aug. 23, 2013, which in turn claims the benefit of AU Patent Application No. AU 2012903651, filed Aug. 24, 2012.

TECHNICAL FIELD

This invention concerns scanning bar hooks used in retail premises to suspend packeted items such as batteries, cutlery and the like.

BACKGROUND

The hooks are carried by a moulded plastic plate which has rear facing pegs for engaging vertical pegboard. The forward extending wire limbs are about 300 mm long. The lower limb ends in an upwardly sloping portion and this prevents suspended packets from falling off the limb. The upper limb ends in a downwardly directed portion which supports a rectangular plate. The plate has a clear plastic envelope for displaying a card showing a bar code and price information.

Such scanning hooks make good use of retail space in that they allow high packing density, are easy to load with replacement packets and instantly readable by shop assistants. The same easy loading encourages theft in that a thief is able to sweep a group of packets into a waiting bag without tearing the eye of the card to which the packets are attached. This allows the stock to be re-hung and sold in another location.

One type of anti-theft hook divides the lower bar into three straight portions separated by two peaks. This ensures that instead of a rapid single sweep, careful manual guiding of the packets in a serpentine path along the bar is necessary. This may attract the attention of store surveillance staff.

SUMMARY OF INVENTION

The apparatus aspect of this invention provides a scanning bar hook comprising an upper and lower limb the upper limb ending in a crossbar, display means to support a bar code carrier, arrester means to prevent departure of suspended items from the lower limb more than one at a time and means uniting the display and arrester means which pivotally engages the crossbar.

Instead of the end portion of the lower limb sloping upwards, the end portion may be cranked.

The arrester means may cause an item to tilt as it leaves the lower limb. The arrester may be a flap disposed at an acute angle to the display means.

The flap may be bifurcated in order to accommodate the crank.

The arrester flap and the display means may define between them a space to receive the crossbar. The arrester flap and the display means may define between them a cylindrical space into which the crossbar is admissible in a snap fit. The device may be provided as a one piece plastic moulding.

Alternatively the arrester may be a substantially L-shaped finger extending rearwards from the display means. The end of the finger may be clear of the display items when the hook is loaded but which rotates to lie between one departing item and the next when an item contacts the display means.

The effect is to block the feed of items toward the exit end of the hook end to reduce departure to one item per tilt of the display means.

The display flap may have a spacer projecting from the display flap for contact by the advancing item as it approaches the hook end. The spacer may be an upright fin extending from the rear face of the flap.

The top edge of the display flap may be rolled over to form a hinge into which the crossbar is admissible in a snap fit.

Advantageous Effects of Invention

1. Theft is made more difficult.
2. Replenishment is easier.

BRIEF DESCRIPTION OF DRAWINGS

One embodiment of the invention is now described with reference to the accompanying drawings, in which.

DESCRIPTION OF EMBODIMENTS

Figure 1:
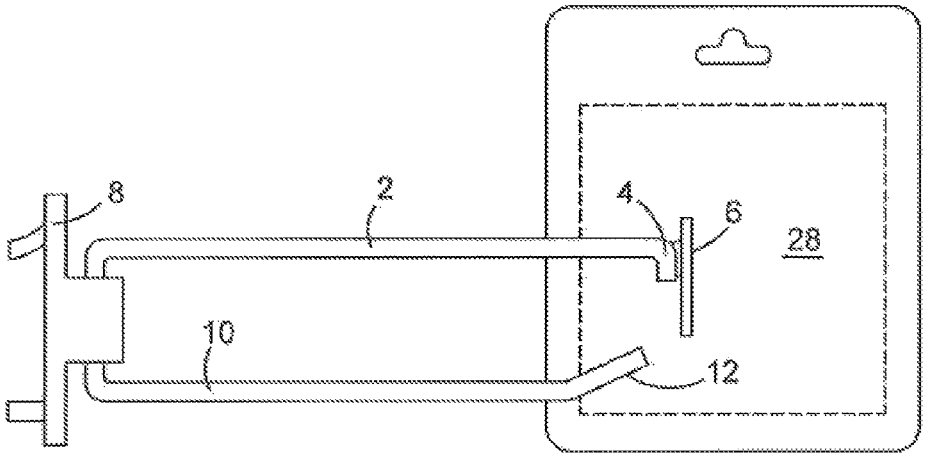
FIGURE 1 PRIOR ART
FIG. 1 is a side view of a prior art hook with a front view of a packet of the type displayed on the hook.

Referring now to FIG. 1, the upper limb 2 of the hook terminates in a downward bend 4 to which is welded thin plate 6. A transparent plastic envelope (not shown) is fixed to the plate's front face. The pegboard plate 8 holds the mid section of the hook and the lower limb 10 ends in an inclined portion 12.

Figure 2:
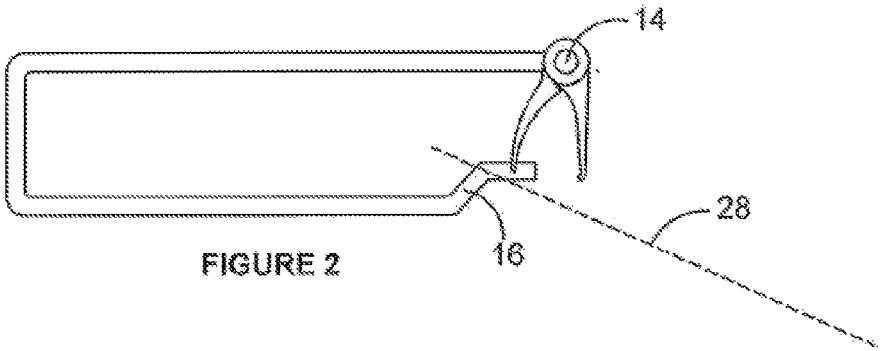
FIG. 2 is a side view of a scanning hook according to the invention.
Figure 3:
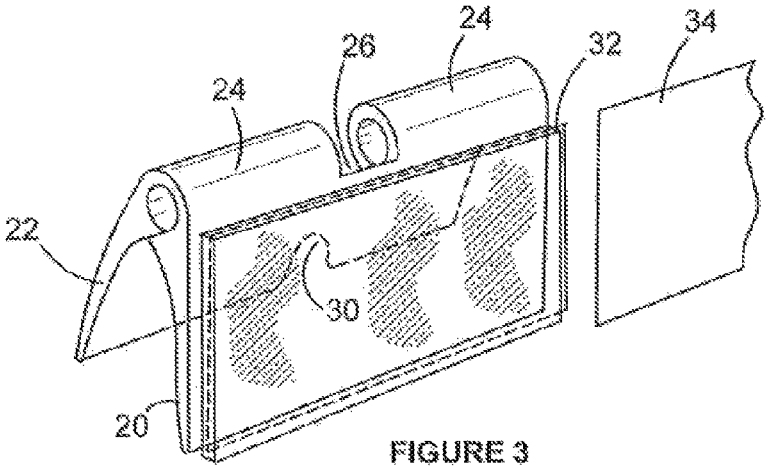
FIG. 3 is a perspective of the arrester and the bar code display.

In FIG. 2 upper limb 2 terminates in crossbar 14 and lower limb ends in crank 16. Upper limb is 360 mm long, while the lower limb is 340 mm long. Crossbar 14 is 70 mm long. The anti-theft device in FIG. 3 is a polyethene moulding having a display flap 20 joined to an arrester flap 22. At the confluence of the flaps is a pair of hinge pockets 24 separated by gap 26, the purpose of which is to accommodate the end of upper limb 2.

The thickness of flaps 20 and 22 increases toward the pockets 24 in order to render it difficult for a thief to remove it from the crossbar 14 on which it is a snap fit.

The angle between the flaps is about 40 degrees and the length of the flap is sufficient to cause the packet 28 (see FIG. 1) to tilt as shown if excess tension is applied in the course of trying to remove it from the lower limb past crank 16.

The arrester has a central cutout 30 to overlie the crank 16. A transparent rectangular envelope 32 is screwed to the display flap by adhesive. This houses the bar code card 34.

Figure 4:
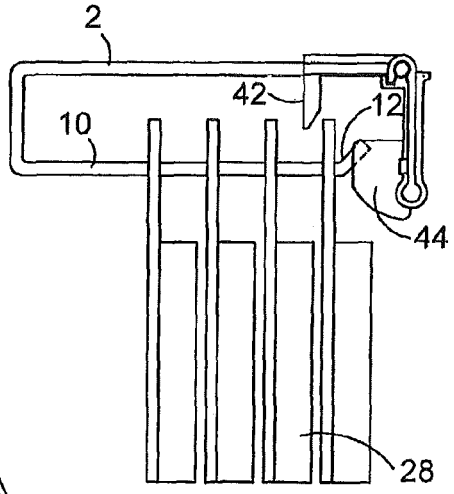
FIG. 4 is a side view of a variant in the loaded position.
Figure 5:
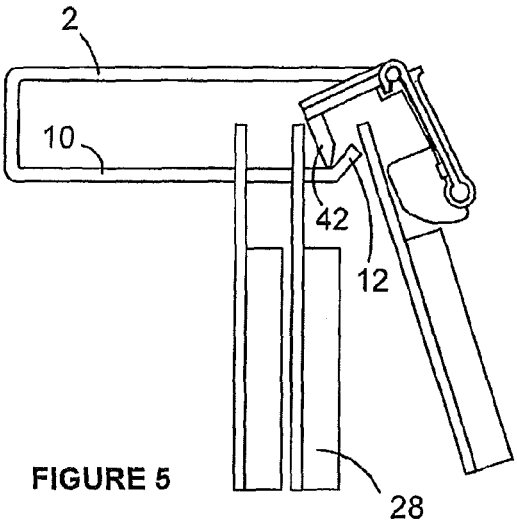
FIG. 5 is the side view of FIG. 4 in the unloading position.
Figure 6:
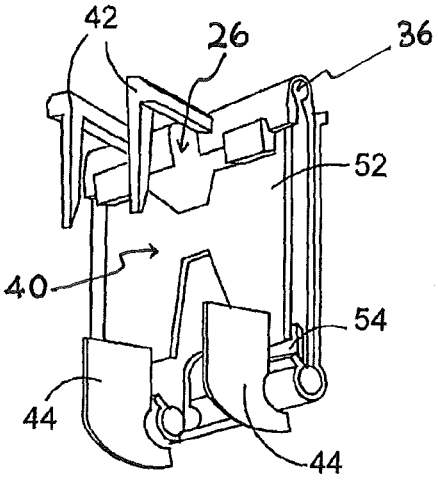
FIG. 6 is the rear view of the display flap.

Referring now to FIGS. 4, 5 and 6, the display flap 20 is rectangular with a top edge which curls rearwards to form a pair of hinge pockets 36 separated by the gap 26. The pockets are a snap fit onto crossbar 14. On the centre axis of the rear face 40, L-shaped arrester arm 42 extends parallel to the upper limb 2 and then at 90 degrees thereto. On the same axis but near the lower edge is a pair of comma-shaped fins 44, the purpose of which is to contact the foremost packet on lower hook limb 10. When the customer advances the foremost packet in order to detach it, the foremost packet contacts the fin 44. The pendant flap 20 rotates, inserting arrester arms 42 between the foremost packet and the following packet 28.

Figure 7:
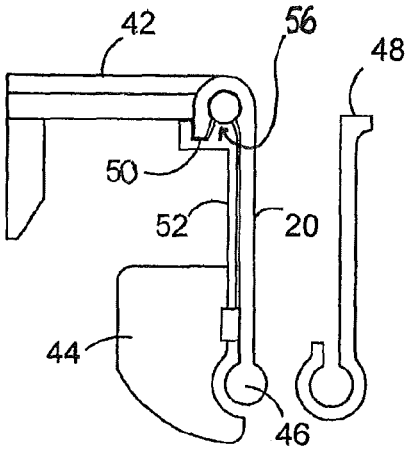
FIG. 7 is a side view of the display flap of FIG. 6.

In FIGS. 6 and 7 the display flap 20 ends in a bead 46 onto which transparent cover 48 is a snap fit. The opposite end of flap 20 has a depending flange 50 from which arm 42 extends. The space between the flap 20 and the flange 50 at this level forms the snapin receptor site for the crossbar. The fins 44 extend from a separate moulding 52 which is trapped between raised abutments 54 at the edges of flap 20 and flange 50. Moulding 52 has channels 56 which receive the edge of flange 50.

Bar code card 34 is insertable behind transparent cover 48.

It is to be understood that the word "comprising" as used throughout the specification is to be interpreted in its inclusive form, ie. use of the word "comprising" does not exclude the addition of other elements.

It is to be understood that various modifications of and/or additions to the invention can be made without departing from the basic nature of the invention. These modifications and/or additions are therefore considered to fall within the scope of the invention.

The invention claimed is:

1. A bar hook for controlling the dispersement of suspended retail items from a bar, the bar hook comprising an upper and a lower limb, the upper limb ending in a crossbar, a display having a front and a rear surface, an arrester to prevent departure of suspended items from the lower limb more than one at a time and a pivot uniting the display and the arrester, which pivot pivotally engages the crossbar, wherein:

the arrester depends downwardly and has an end portion that is spaced rearwardly from the rear surface of the display to accommodate the width in side view of a first suspended item; and the display includes a spacer surface rearwardly spaced from the front surface and adapted to lie positioned closer to the first suspended item than to the rear surface of the display.

2. The bar hook as claimed in claim 1, wherein the arrester is a flap disposed at an acute angle to the display.

3. The bar hook as claimed in claim 2, wherein a top edge of the display is rolled over to form a hinge into which the crossbar is admissible in a snap fit.

4. The bar hook as claimed in claim 2, wherein the flap is convex and curved in side profile whereby the end portion curves towards the display.

5. The bar hook as claimed in claim 1, wherein the lower limb has an end portion in the form of a crank.

6. The bar hook as claimed in claim 5, wherein the arrester is bifurcated in order to accommodate the crank.

7. The bar hook as claimed in claim 5, wherein the end portion slopes upwards.

8. The bar hook as claimed in claim 1, wherein the arrester and the display define between them a space to receive the crossbar.

9. The bar hook as claimed in claim 1, wherein the arrester and the display are a one piece plastic moulding.

10. The bar hook as claimed in claim 1, wherein the arrester is a substantially L-shaped finger extending rearwards from the display.

11. The bar hook as claimed in claim 10, wherein the end of the finger lies clear of the suspended items when the scanning bar hook is loaded but rotates to lie between one departing item and the next when an item contacts the pivoted display.

12. The bar hook as claimed in claim 1, wherein the display is a flap that has a spacer projecting from the display flap for contact by an advancing item as it approaches the end of the lower limb.

13. The bar hook as claimed in claim 12, wherein the spacer is an upright fin extending from a rear face of the display flap.

14. The bar hook as claimed in claim 1, wherein the display is a panel onto which a transparent cover can be snap fit on the panel.

15. The bar hook as claimed in claim 14, wherein the arrester comprises a pair of arrester arms which extend from the panel's top edge and a separate spacer carrier is supported on a rear of the panel between the top edge and a bottom edge of the panel.

16. The bar hook as claimed in claim 15, wherein the spacer carrier has a pair of rearwardly extending arcuate fins for contacting a departing item in order to rotate the arresting arms.

17. The bar hook as claimed in claim 1, wherein the arrester comprises an arm having a first portion extending substantially normal to the display and the end portion is aligned substantially parallel with the display.

18. The bar hook as claimed in claim 17, wherein the arm has a right angled elbow intermediate the first portion and the end portion.

19. The bar hook as claimed in claim 18, wherein the end portion comprises a pair of spaced prongs.

20. The bar hook as claimed in claim 1, wherein the display is to support a bar code carrier.

* * * * *